United States Patent [19]

Schnell

[11] 3,951,228

[45] Apr. 20, 1976

[54] NOISE REDUCTION ENCLOSURE FOR A MACHINE

[75] Inventor: Albert C. Schnell, Hickory Hills, Ill.

[73] Assignee: Continental Can Company, Inc., New York, N.Y.

[22] Filed: Jan. 6, 1975

[21] Appl. No.: 538,908

[52] U.S. Cl. ..... 181/33 K
[51] Int. Cl.[2] ..... E04B 1/99
[58] Field of Search ..... 181/33 K, 33 R; 49/303–310, 475–480; 113/1 R, 7 R

[56] References Cited

UNITED STATES PATENTS

| | | | |
|---|---|---|---|
| 3,276,539 | 10/1966 | Dear et al. | 181/53 K |
| 3,703,997 | 11/1972 | Epina | 181/33 K |
| 3,773,140 | 11/1973 | Mahajan et al. | 181/33 K |
| 3,851,725 | 12/1974 | Schnell et al. | 187/33 K |
| 3,860,086 | 1/1975 | Mahajan | 181/33 K |

*Primary Examiner*—L. T. Hix
*Assistant Examiner*—Vit W. Misko
*Attorney, Agent, or Firm*—Lockwood, Dewey, Zickert & Alex

[57] ABSTRACT

Noise reduction enclosure for enclosing a sound-producing machine, including interconnected upstanding side walls and a ceiling at the upper ends of the side walls, wherein the side walls and ceiling are constructed of beams and support members having sheet metal panels floatingly mounted thereon. Resilient sealing members are mounted on the periphery of the sheet metal panels to isolate the panels from the beams and support members and to prevent noise leaks. Resilient grommets coact with fasteners to isolate the fasteners from the panels and to fix spacing between the panels and beams or support members, thus controlling proper compression of resilient sealing members. Openings are provided in the side walls of the panels and doors coact with the openings to provide access to the machine. The doors and doorways are arranged such that about ninety percent of the machine is available for servicing when the doors are in open position. Resilient sealing members are provided around the periphery of the doors to prevent noise leaks. Vibration absorbing means isolates the beams and support members from the floor.

19 Claims, 19 Drawing Figures

FIG. 6
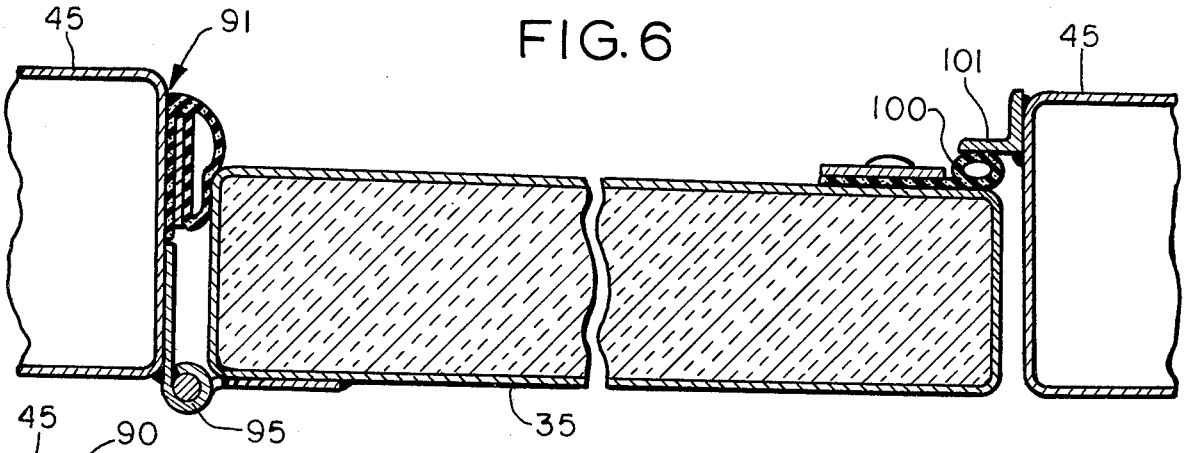
FIG. 7
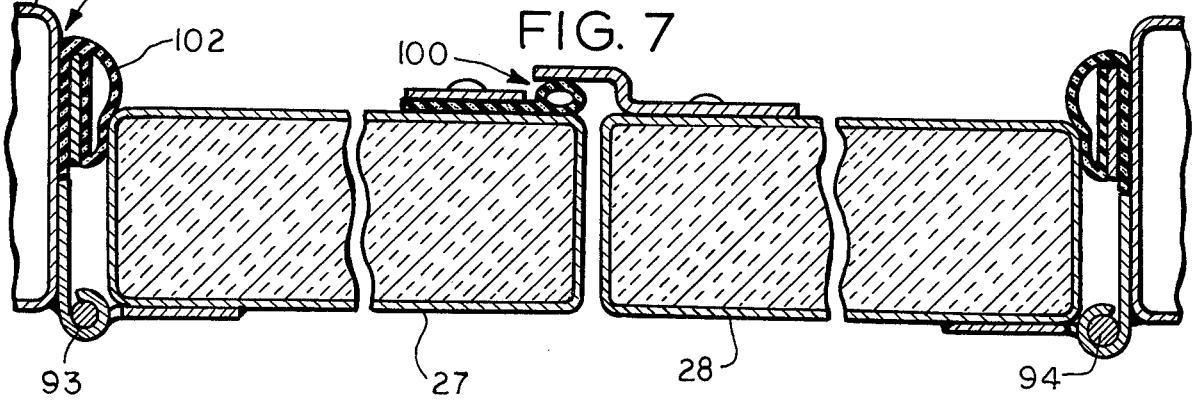
FIG. 8
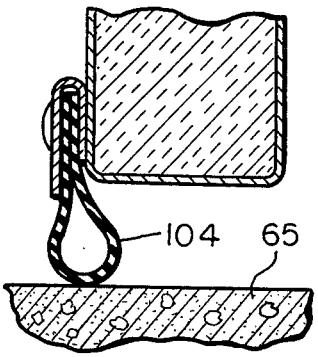
FIG. 11
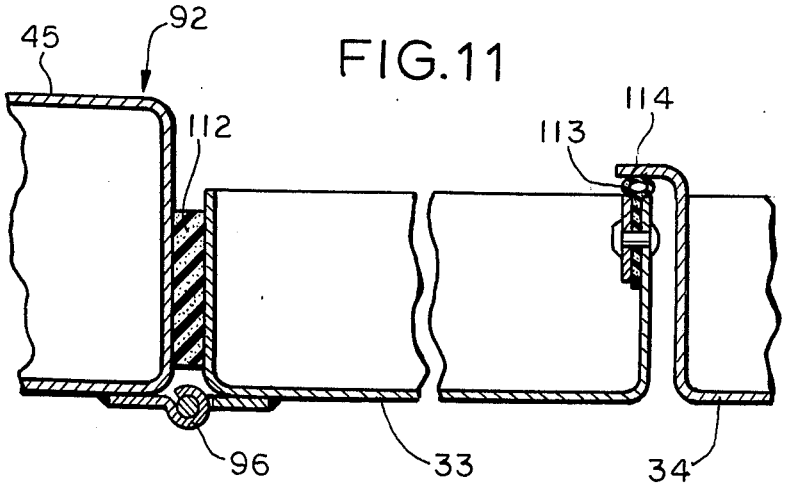
FIG. 9
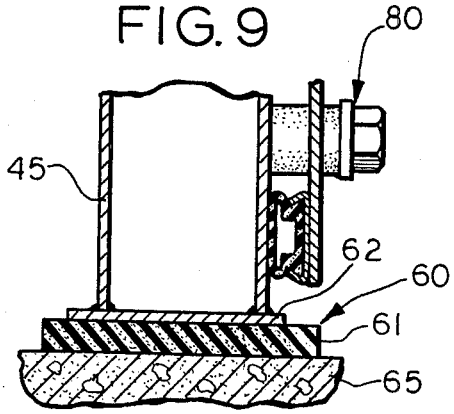
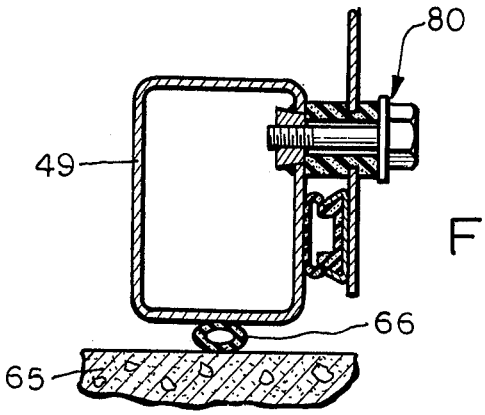
FIG. 10

NOISE REDUCTION ENCLOSURE FOR A MACHINE

This invention relates in general to enclosures for sound-producing machines, and more particularly to sound-reducing enclosures capable of reducing the noise level in the area surrounding the machine.

Because of the noise level regulations set by the Occupational Safety and Health Administration (OSHA), it has been necessary to provide noise-reducing enclosures for machines producing a noise level in excess of that allowed by OSHA. Even before OSHA, noise-reduction enclosures or cabinets have been known for use with various noise-producing apparatus. Many methods and materials are presently and commercially available for building such noise-reducing assemblies. For example, the most common enclosures are constructed from thick wall interlocking panels and doors. The noise-reducing enclosure of the present invention is especially adaptable for high-speed machinery. Such high-speed machinery frequently encounters jams and requires maintenance work, thereby necessitating frequent and quick access to reduce down time. Additionally, access to the machine for feeding in raw materials and feeding out completed products is necessary. In order to provide such accessibility, it is necessary to utilize many swinging or sliding doors to expose the vital areas of the machine quickly. This cannot be accomplished with present commercially available systems without incurring great expense. Particularly, the doors of commercially available systems are a major cost factor.

Moreover, commercially available systems use interlocking panels or interlocking panels coacting with joiner beams. To remove a given panel in the center of a wall for providing access, the wall must be disassembled beginning at a corner and working toward the panel needed to be removed. Such not only increases maintenance time but also the down time of the machine.

Presently known wall panel structures are of a sandwich construction resulting in heavy and cumbersome panels. The inner wall of such panels are normally of perforated metal which can trap or hold oil and dirt which is encountered in connection with high-speed automatically lubricated machinery. Panel thickness ranges from 1 to 6 inches with four inches being the most common. While such panel construction is ideal for superquiet conditions, it is not necessary or preferable in production or industrial environments.

Heretofore, simple sheet metal panels have been avoided on the basis they vibrate easily, and when vibration is encountered, little or no noise reduction is obtained in the area surrounding the enclosure.

The noise-reducing enclosure of the present invention overcomes the vibration problem heretofore existing with sheet metal panels and therefore provides a noise-reducing enclosure utilizing sheet metal panels that are easy to handle and inexpensive to manufacture. Vibrations are minimized in the sheet metal panels by utilizing a unique isolation spacer and seal system. More particularly a resilient seal assembly is mounted on the periphery of the sheet metal panels for engaging the beams and support members of the enclosure and resilient grommets are mounted in holes in the panels and which receive fasteners that are thereby isolated from the panels and serve to fasten the panels on the beams and support members.

Accordingly, it is an object of the present invention to provide a noise-reducing enclosure that is capable of using easy-to-handle and inexpensive sheet metal panels.

Ventilation systems can be purchased with commercially available enclosure systems. They usually include blowers and fresh air intakes, the latter of which are formed from a series of ducts and tunnels designed to absorb noise before leaking out of the enclosure. The ducts and tunnels are additional to the enclosure walls.

The present invention does not utilize separate ducts or tunnels that must be added to the enclosure but builds a ventilation system into the framework of the enclosure, thereby eliminating costs of separately providing a ventilation system.

It is therefore another object of the invention to build a ventilation system into the enclosure structure to reduce overall costs of the enclosure.

Still another object of the present invention is to provide maximum accessibility to the machine in the form of doorways and swinging doors which when open allow access to about 90 percent of the machine.

A still further object is to provide a soundreducing enclosure that utilizes commercially available doors to provide easy access into the enclosure.

Other objects, features and advantages of the invention will be apparent from the following detailed disclosure, taken in conjunction with the accompanying sheets of drawings, wherein like reference numerals refer to like parts, in which:

FIG. 6 is a greatly enlarged broken sectional view taken along lines 6—6 of FIG. 1;

FIG. 7 is a greatly enlarged broken sectional view taken along line 7—7 of FIG. 1;

FIG. 8 is a greatly enlarged vertical sectional view taken along line 8—8 of FIG. 1 and showing the seal at the bottom of the doors;

FIG. 9 is a greatly enlarged vertical sectional view taken along line 9—9 of FIG. 2 and illustrating the shock absorbing pad on which the vertical beam is mounted;

FIG. 10 is a vertical sectional view taken substantially along line 10—10 of FIG. 2 and illustrating the seal between the horizontal lower beams and the floor;

FIG. 11 is a greatly enlarged broken horizontal sectional view taken substantially along line 11—11 of FIG. 2 and showing the sealing arrangements for the transom doors at the front and back of the enclosure;

Figure 3:
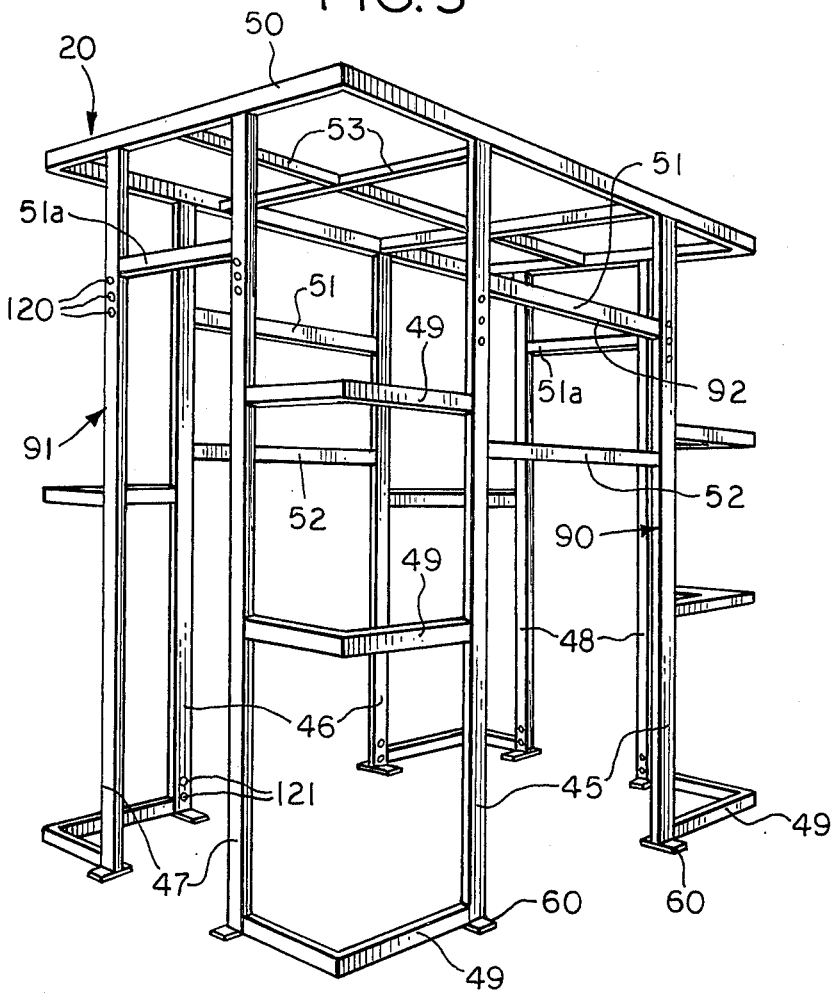
FIG. 3 is a perspective view of the framework for the noise-reducing enclosure of the invention showing the horizontal and vertical beams for the side walls and the channel support members for the ceiling.

The noise-reducing enclosure of the present invention includes generally a framework 20, as seen in FIG. 3, covered with corner panels 21, front and side transom panels 22 and 23, material passage panels 24 and 25, ceiling panels 26, front walk-through doors 27 and 28, front transom doors 29 and 30, rear walk-through doors 31 and 32, rear transom doors 33 and 34, end walk-through doors 35 and 36, and end transom doors 37 and 38.

The corner panels, transom panels, material passage panels and ceiling panels are fabricated of sheet metal floatingly mounted on the framework and sealed relative the framework with resilient seal members. Sealing members are mounted at the peripheries of the doors to seal against the leakage of noise.

Figure 4:
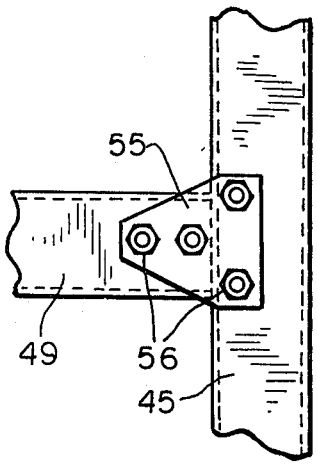
FIG. 4 is a detailed enlarged elevational view of a joiner plate connecting together a vertical and horizontal beam of the framework.

The framework 20 includes front and rear vertical tubular beams 45 and 46, opposing end vertical beams 47 and 48, corner beams 49 at each of the corners of the enclosure between vertical beams, horizontal roof beams 50, front and rear upper and lower horizontal door arch beams 51 and 52, end horizontal door arch beams **51*a*, and light-weight, U-shaped channels 53 forming ceiling support members. While not shown in FIG. 3, the beams are connected together by commercially available joiner plates 55 which are secured to adjacent beams by means of suitable fasteners 56, as seen in FIG. 4**.

The vertical and horizontal beams are in the form of rectangular welded steel tubing of about two inches by four inches cross-sectionally although the tubing may be of any desired size. It should be further appreciated that any other suitable type of joining means other than the joiner plates may be utilized to join adjacent beams together. Accordingly, the beams are hollow which facilitates building in a ventilation system that eliminates the need for separate duct work to be added to an enclosure as will be more clearly appreciated hereafter.

In order to reduce the transmission of vibrational energy from the floor into the framework 20, each vertical beam is set upon a commercially available machine shock mount or pad 60 which may take any desired form, such as illustrated specifically in FIG. 9 wherein it may include a resilient pad 61 and a metal plate 62 that would prevent the vertical beam 45 from cutting into the pad 61.

Since the corner beams 49 adjacent to the floor 65 must not directly engage the floor and therefore must be spaced slightly therefrom as illustrated in FIG. 10, a hollow extruded rubber seal strip 66 is provided to prevent noise leakage beneath the lowermost corner beams. It should be appreciated that the seals utilized with the enclosure of the invention may be made of natural or synthetic rubber or of any other suitable plastic, and for simplicity purposes reference herein to rubber seals will be intended to cover any type of suitable resilient seal member.

It may therefore be recognized the shock mounts 60 and the rubber seals 66 isolate the framework 20 from the floor to prevent the framework from directly contacting the floor and therefore minimizing the transfer of vibrational energy from the floor to the framework. Inasmuch as sheet metal panels are used for covering much of the framework according to the present invention, it is important to prevent vibrational energy from reaching the panels through the framework inasmuch as vibration in the panels reduces the effectiveness of stopping noise transmission through the enclosure.

Figure 5:
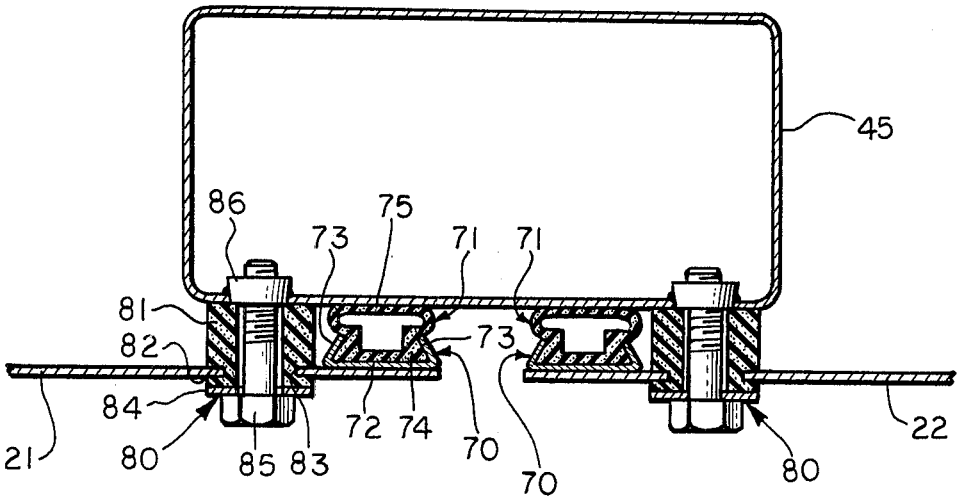
FIG. 5 is a greatly enlarged sectional view taken along line 5—5 of FIG. 1.

The corner panels 21, the transom panels 22 and 23, and the ceiling panels 26 are fabricated of 16 gauge thickness sheet metal. However, any other suitable gauge thickness may be used. The panels are floatingly mounted on the framework and sealed at the edges to prevent noise leakage. Each of the corner and transom panels along the side walls of the enclosure has seal retaining and stiffening channels 70 welded along the periphery for receiving extruded hollow rubber seal members 71. Each of the channels includes a base portion 72 lying flush against the corresponding panel and outwardly and inwardly projecting lip portions 73 between the free edges of which define a slot, as seen in FIG. 5. Each of the rubber seal members 71 includes a base portion 74 matingly received within the retainer 70 and an outer portion 75 protruding from the retainer and to engage against a beam, as shown in FIG. 5. The outer portion 75 is somewhat compressed, thereby assuring a good sealing relation between the seal and the beam to prevent noise leakage. Since the sheet metal panels are of relatively thin walls and therefore somewhat flexible, the channels 70 welded to the periphery serve to stiffen the panel. Additionally, the channels form a mount for the seals 71 which may be slipped into the channels in locking relationship, thereby eliminating the need for securing the seals by rivets, adhesives, screws or other fastening means to the panels.

The corner panels 21 and the transom panels 22 and 23 are secured to the beams by a plurality of fastening assemblies 80, as seen most clearly in FIGS. 5, 9 and 10. Each fastening assembly includes a resilient or elastomeric isolation means in the form of a rubber grommet 81, generally cylindrical in shape, having an annular slot 82 for fitting in a suitable hole 83 formed in a panel, a washer 84 abutting against the outside surface of the grommet, a capscrew or stud 85 which extends through the washer and through a central opening in the grommet and is anchored in a suitable nut 86 secured to the beam. The rubber grommet 81 completely isolates the panel from the beam and the framework of the enclosure so that the panels are floatingly mounted on the beams and so that any vibration in the beams is dampened or absorbed by the grommets and not transferred to the panels. Further, the grommet isolates the mounting bolts or capscrews 85 from the panels. It should also be appreciated the grommet 81 will control the spacing between the panels and the frame so as to maintain a proper spacing between the seal retaining and stiffening channels 70 and the frame to prevent the seal 71 from being over-compressed, and thereby preventing the channel from possibly cutting the seal and destroying its effectiveness. Further, the spacing between the panels and the beams as dictated by the grommets will prevent development of large reaction forces along the seals which might in turn bend the panels and reduce their effectiveness.

It can now be appreciated that the corner panels 21 are interchangeable, the transom panels 22 on the front and back sides of the enclosure are interchangeable, and the transom panels 23 at the opposite ends of the enclosure are interchangeable. Further, any one of the panels may be removed without necessitating removal of another panel if it need be done to obtain access to a particular part of the machine. The unique mounting arrangement of the panels on the beams, together with the control of the compression of the seals, permits use of relatively thin sheet metal panels which are much more economical than the presently known multi-layer bulk panels. The panel fastening assemblies and sealing arrangements prevent the transmission of vibrational energy from the framework of the enclosure to the panels and the leakage of noise from within the enclosure.

Figure 15:
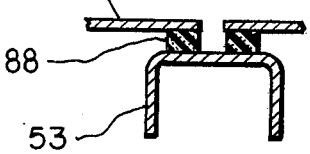
FIG. 15 is a greatly enlarged vertical sectional view taken substantially along line 15—15 of FIG. 1 illustrating the seal for the ceiling panels.

The ceiling panels 26 are also preferably made of thin sheet metal such as about 16 gauge or the like. While the same type of seal and mounting arrangements as utilized on the side panels may be used on the ceiling panels, such is not necessary. As seen in FIG. 15, the ceiling panels 26 are floatingly mounted on resilient strips of material 88, such as about ⅜ inch thick by about 1 inch wide polyvinyl chloride cell foam seals. Suitable fasteners may be provided if desired.

The front and back walls of the enclosure are provided with door openings 90 for the front and back double doors 27, 28 and 31, 32. The opposing end walls of the enclosure are provided with door openings 91 which receive the walk-through doors 35 and 36, together with the transom doors 37 and 38. At the front and back walls of the enclosure, transom door openings 92 receive the front transom doors 29 and 30 and the rear transom doors 33 and 34. The front and rear transom doors are at about the same height as the end wall transom doors and the front and rear walk-through doors are at about the same height as the end wall walk-through doors. The walk-through doors and the transom doors are swinging doors. More specifically, the front and back walk-through doors are hingedly mounted to the corresponding vertical beams by hinges 93 and 94, while the end wall walk-through doors are mounted to vertical beams by hinges 95. Similarly, the front and rear transom doors are hingedly mounted to the vertical beams by means of hinges 96, while the end wall transom doors are suitably mounted to the vertical beams by similar hinges 96.

The walk-through swinging doors at the side walls are of a standard commercial type used as office doors, such as those of double hollow sheet metal wall construction filled with a paper honeycomb core. Accordingly, the doors are relatively inexpensive compared to specially constructed soundproof type doors. The transom doors are fabricated of sheet metal and include a stiffening flange formed along the periphery. For example, the thickness of the sheet metal used may be the same as that used for the sheet metal panels of the enclosure.

Each of the walk-through doors is provided with a large plexiglas window 98 to permit visual inspection of the machine while it is running without having to open up a door. Additionally, one or more of the transom doors, such as the transom doors 30 and 34, may be provided with a plexiglas window 98 for visual inspection of the machine during its operation.

Figure 12:
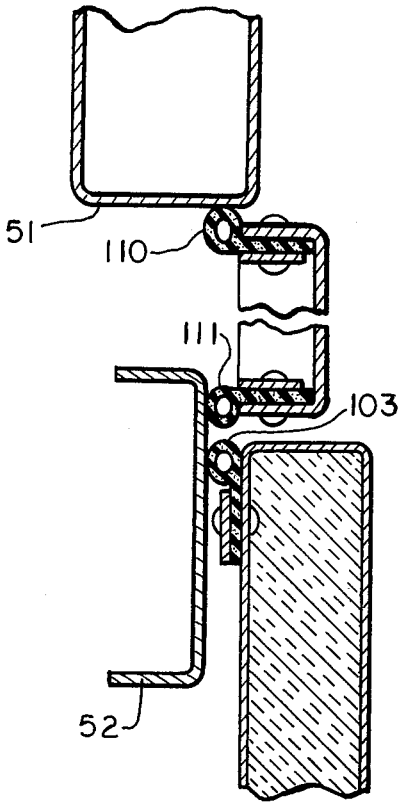
FIG. 12 is a greatly enlarged broken vertical sectional view taken substantially along line 12—12 of FIG. 2 and showing the manner in which the transom doors and the walk-through doors seal along their horizontal edges.
Figure 13:
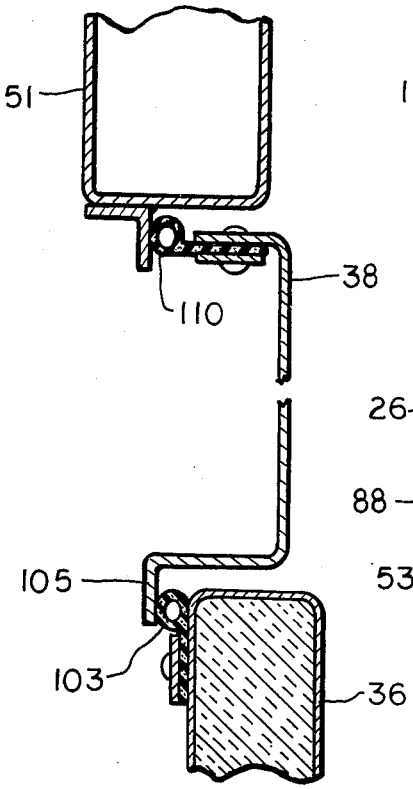
FIG. 13 is a greatly enlarged broken vertical sectional view taken substantially along line 13—13 of FIG. 2 and showing the manner in which the horizontal edges of the transom door are sealed.

In order to prevent noise leakage along the peripheries of the double walk-through doors, a hollow extruded rubber seal 100 may be provided along the vertical non-hinged edge of one walk-through door at the front and rear walls for coacting with a flange 101 secured to the vertical non-hinged edge of the other walk-through door, as seen in FIG. 7, while a hollow E-shaped extruded rubber seal 102 may be mounted along the vertical hinged edge of the walk-through doors and to the adjacent vertical beam. The seal 100 may be suitably pop-riveted to the door. Similarly, the flange 101 may be suitably fastened to the other door and the E-shaped seal 102 may be fastened to the appropriate vertical beams. The upper horizontal edges of the front and back walk-through doors are provided with a suitable rubber seal 103, as seen in FIG. 12, and which may be pop-riveted to the door and which will engage the lower horizontal door arch beam 52. In order to seal against noise leaks along the lower edges of the swinging doors, a rubber seal 104 may be suitably fastened to the door so that it will engage the floor 65 as seen in FIG. 8. The walk-through doors at the end walls are provided with similar seals, as seen in FIGS. 6 and 13. However, since there is no door arch beam at the upper end of the walk-through door, the upper horizontal seal 103 coacts with a lip 105 formed on the flange of the transom door, as seen in FIG. 13.

The front and back wall transom doors are provided with hollow extruded rubber seals 110 and 111 at the upper and lower horizontal edges, as seen in FIG. 12, to coact with and seal with the door arch beams 51. The vertical hinge edge of the transom doors engages against and compresses a resilient seal strip 112, such as in the form of a closed cell foam tape, as seen in FIG. 11. The non-hinged vertical edge of one door includes a rubber seal 113 coacting with a seal lip 114 formed on the non-hinged vertical flange of the adjacent door, as shown in FIG. 11. The seals 110, 111 and 113 may be suitably riveted or otherwise fastened to the flanges of the transom doors, while the seal strip 112 may be suitably adhesively fastened to the adjacent vertical beam 45 at the hinged edges of the transom doors.

Figure 14:
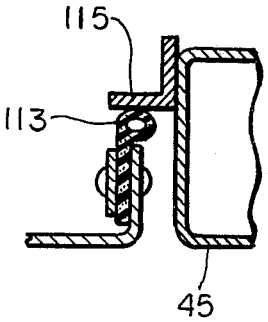
FIG. 14 is a greatly enlarged horizontal view taken substantially along line 14—14 of FIG. 2 and showing the manner of sealing the transom door at the free vertical edge.

The end wall transom doors 37 and 38 similarly have mounted thereon at the upper horizontal edge and non-hinged vertical edge extruded rubber seals like the seals 110 and 113, as shown in FIGS. 13 and 14, while the hinged vertical edge of these transom doors are sealed like the transom doors at the front and back walls of the enclosure, as seen in FIG. 11. The non-hinged edge of each end wall transom door coacts with a sealing plate 115 mounted on the adjacent vertical beam 45, as seen in FIG. 14. As above already explained the lower horizontal edges of the end wall transom doors are provided with lips 105 for engaging seals 103 on the walk-through doors, as seen in FIG. 13.

Figure 2:
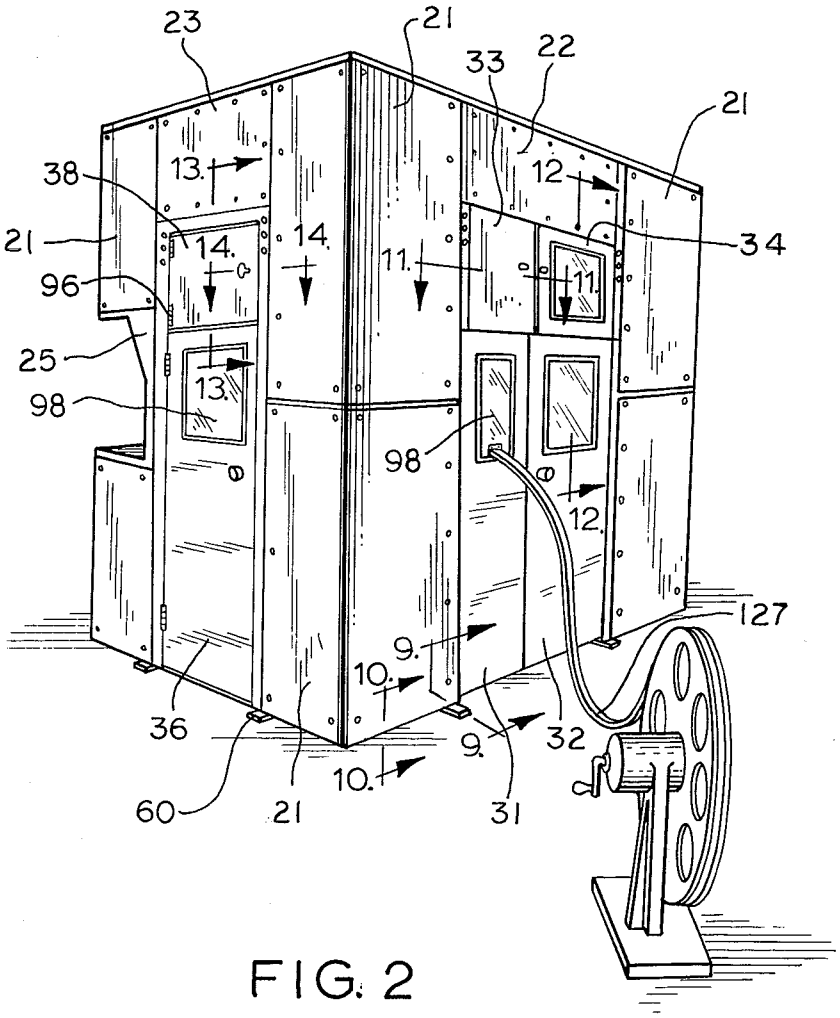
FIG. 2 is a rear perspective view of the enclosure of FIG. 1 taken from the opposite side and showing the doors in closed position.
Figure 1:
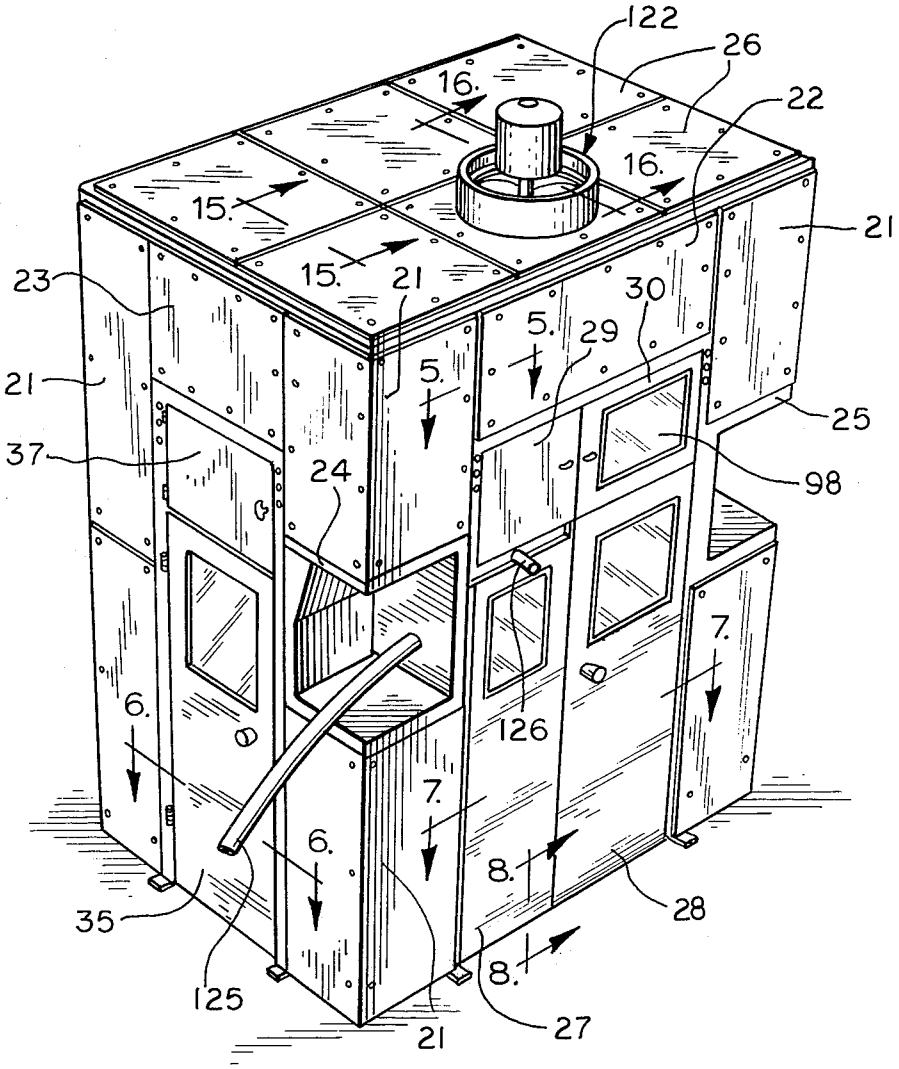
FIG. 1 is a front perspective view of a noise-reducing enclosure according to the invention showing the doors in closed position.
Figure 18:
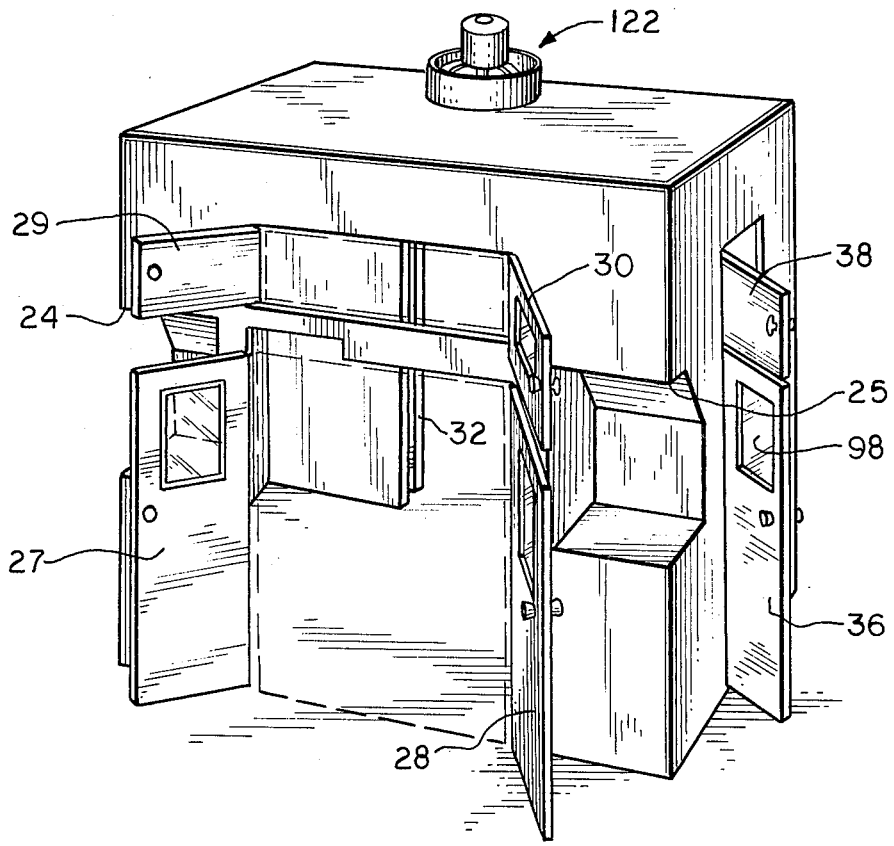
FIG. 18 is a somewhat diagrammatic perspective view of the enclosure looking from the front side and illustrating the doors in open position for obtaining access to the machine which is generally illustrated in phantom.
Figure 19:
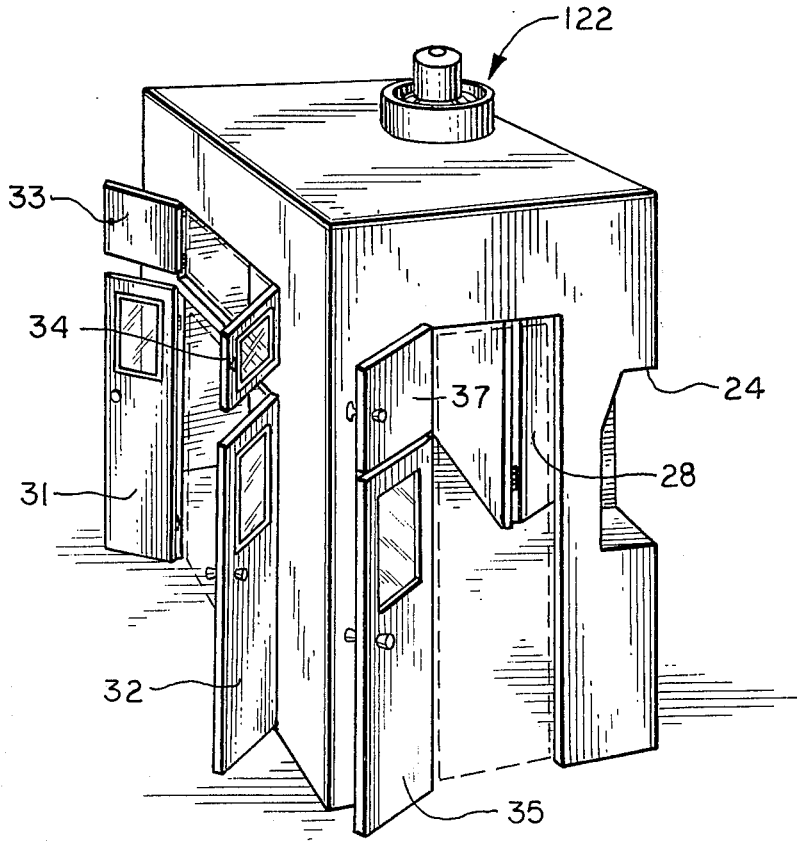
FIG. 19 is a diagrammatic perspective view of the enclosure taken from the end and also illustrating the doors in open position for obtaining access to the machine.

While no particulars of any door latching mechanisms are shown, it will be appreciated that suitable latching arrangements will be provided to maintain the doors in closed position, as illustrated in FIGS. 1 and 2. The doors, when in open position, are as shown in FIGS. 18 and 19, wherein the machine outline is illustrated in phantom and where substantially the entire width of the machine may be viewed when the doors on the front and back walls are opened and substantially the entire depth of the machine may be viewed when the doors on the end walls are opened. As an example for use of the noise-reducing enclosure of the invention, such may enclose a Minster end forming press where the enclosure is in the form of a rectangular box 9 feet 4 inches wide, 6 feet 4 inches deep, and 11 feet 4 inches high. About 41 percent of the enclosure side wall surfaces are occupied by swinging doors located such that when they are open about 95 percent of the machine is exposed for maintenance.

Figure 16:
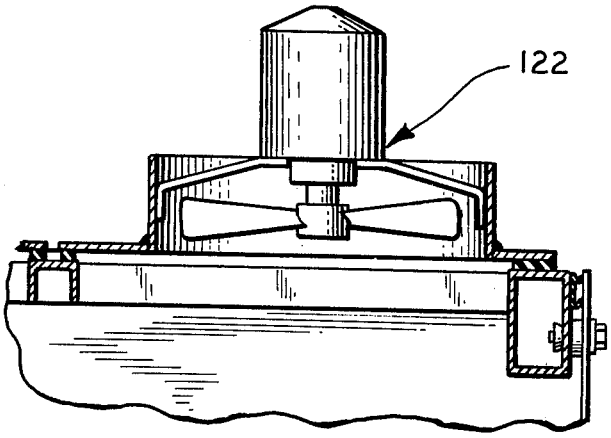
FIG. 16 is a greatly enlarged vertical sectional view taken substantially along the line 16—16 of FIG. 1 showing the exhaust fan mounting.

The ventilation system for the enclosure of the invention eliminates the need for adding extra duct work. In this respect, each of the vertical beams 45, by virtue of being tubular and hollow, forms duct work for the enclosure. At the outer sides of each of the beams, a series of three holes 120 are formed as air intakes and which are exposed to the surrounding area, as seen in FIGS. 1 and 2. These holes are positioned near the upper ends of the transom doors. A series of two larger holes 121 are provided along the inner surfaces of each of the vertical beams and adjacent the floor, as particularly seen in FIG. 3, wherein the vertical beams serve as ducts to bring air from outside of the enclosure to the interior of the enclosure. Any suitable size or number of holes may be provided to give the desired ventilation. An exhaust fan or blower 122, FIGS. 1 and 16, is mounted in the ceiling of the enclosure and during operation will draw air from outside of the enclosure through the inlet holes 120 to the interior of the enclosure through the holes 121 and then upwardly through the exhaust fan. If desired, a suitable piping may be provided to exhaust the air from the exhaust fan to the exterior of the building in which the enclosure is located. Because of the length of the vertical beams which serve as air supply ducts, they act as good noise attenuating ducts. If noise exiting from the holes 120 is excessive, long strips of noise absorbing material, such as open cell polyurethane foam, can be placed inside the beams at the holes 121 to absorb any noise entering holes 121.

Figure 17:
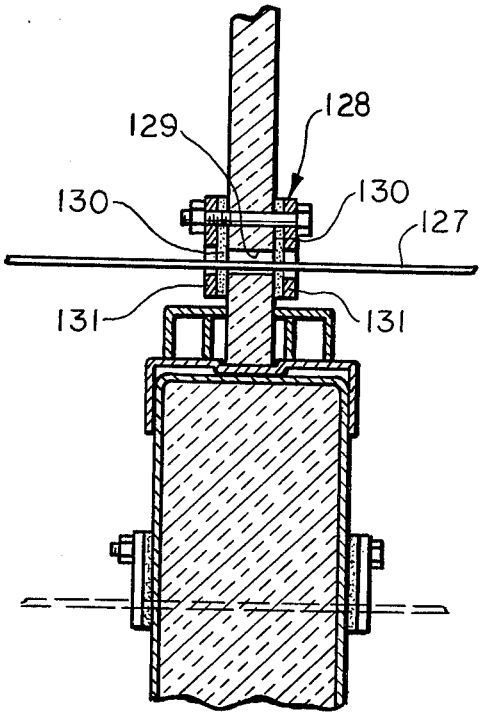
FIG. 17 is a greatly enlarged vertical sectional view taken through a rear door of the enclosure and particularly through the noise trap for the tab stock.

In order to feed end units into the machine and through the enclosure walls, a suitable conveyor 125, as seen in FIG. 1, may be provided through a material passage panel 24. The end units may exit from the enclosure through a suitable conveyer 126. Conveyers 125 and 126 may have suitable noise absorbing tunnels or traps. Tab stock or thin metal strip 127 may be fed through a noise trap 128, as shown in FIG. 17. The noise trap includes a slot 129 cut through the door, together with felt pads 130 through which the tab stock 127 moves. Suitable retaining plates 131 may be used to hold the felt wiper pads in place. The small air gap between the felt wiper pads arranged on opposite sides of the door form a noise trap for noise leaking past the inner felt pad.

It should further be appreciated that suitable noise seal tunnels may be provided for the conveyors 125 and 126.

It will be understood that modifications and variations may be effected without departing from the scope of the novel concepts of the present invention, but it is understood that this application is to be limited only by the scope of the appended claims.

The invention is hereby claimed as follows:

1. A noise reduction enclosure for enclosing a sound-producing machine supported on a floor to reduce the noise level in the area surrounding the machine, said enclosure including a plurality of interconnected side walls upstanding from the floor and a ceiling at the upper ends of the side walls, access means including an opening and a door therefor in at least one of the side walls providing access to the interior of the enclosure, said side walls including a plurality of interconnected vertical and horizontal tubular beams and sheet metal panels, vibration absorbing means between the vertical beams and the floor, means floatingly mounting the panels on the beams to inhibit transfer of vibrational energy from the beams to the panels, said ceiling including a plurality of support members connected to said beams and sheet metal panels, said means floatingly mounting said panels on the beams including fasteners and elastomeric isolation means between the fasteners and the panels, means floatingly mounting the panels on the support members to inhibit transfer of vibrational energy from the support members to the panels, sealing means between the panels and the beams and the support members to inhibit noise transfer between the interior and exterior of the enclosure, sealing means between the panels and the floor to inhibit noise transfer between the interior and exterior of the enclosure, and sealing means between the door and opening thereof and the door and floor when the door is in closed position to prevent noise transfer between the interior and the exterior.

2. A noise reduction enclosure as defined in claim 1, wherein said means floatingly mounting the panels on the beams and support members includes fasteners and resilient grommets between the fasteners and the panels.

3. A noise reduction enclosure as defined in claim 1, wherein said sealing means between the panels and the beams and the panels and the support members includes retainers mounted along the periphery of each panel, and resilient sealing members received by said retainers engaging the beams and support members.

4. A noise reduction enclosure as defined in claim 1, wherein said sealing means between the door and opening and door and floor includes resilient sealing members at the periphery of the door.

5. A noise reduction enclosure as defined in claim 1, which further includes a ventilation system having openings in a plurality of said vertical beams adjacent the floor and communicating with the interior of the enclosure, openings in those said vertical beams adjacent the upper ends thereof and communicating with the exterior of the enclosure, and an exhaust fan mounted on the enclosure.

6. A noise reduction enclosure as defined in claim 1, wherein said access means includes a plurality of openings and doors therefor in the side walls of the enclosure such that accessibility to about ninety percent of the machine is provided.

7. A noise reduction enclosure as defined in claim 2, wherein said sealing means between the panels and the beams and the panels and the support members includes retainers mounted along the periphery of each panel, and resilient sealing members received by said retainers engaging the beams and support members.

8. A noise reduction enclosure as defined in claim 5, wherein noise-absorption material is included inside the beams at the interior beam openings.

9. A noise reduction enclosure as defined in claim 6, wherein said access means includes a plurality of openings and doors therefor in the side walls of the enclosure such that accessibility to about 90 percent of the machine is provided.

10. A noise reduction enclosure as defined in claim 6, wherein the side walls further include material passages having seal means inhibiting noise leaks.

11. A noise reduction enclosure for enclosing a sound-producing machine supported on a floor to reduce the noise level in the area surrounding the machine, said enclosure comprising opposed front and back walls and opposed opposite end walls upstanding from the floor, a ceiling at the upper ends of the walls, said walls and ceiling including a framework of vertical and horizontal rectangular tubular beams along the walls and channel members along the ceiling, means mounting the framework on the floor to prevent transfer of vibration energy from the floor to the framework and to seal against noise leaks, doorway openings formed in the framework at each of the walls and doors for the doorway openings sized to provide access to about 90 percent of the machine, sealing means at the periphery of each door sealing against noise leaks, sheet metal panels mounted on the framework on the walls and ceiling, a seal assembly at the periphery of each panel on the walls including a seal retaining and stiffening channel secured to the panel and a rubber sealing strip carried by the channel for sealing against noise leaks around the panels, means floatingly mounting the panels on the walls and controlling the compression of the rubber sealing strips including a plurality of fastener assemblies each having a bolt extending through the panel and threadedly received by a beam and a rubber grommet connected between the panel and the bolt to isolate the panel from the beam and the bolt.

12. A noise reduction enclosure as defined in claim 11, wherein said doors include lower walk-through doors and upper transom doors.

13. A noise reduction enclosure as defined in claim 11, wherein said seal retaining and stiffening channel defines an outer slotted trapezoidal in cross section area for receiving the rubber sealing strip.

14. A noise reduction enclosure as defined in claim 11, which further includes a built-in ventilation system comprising openings in at least one of the vertical beams on the outer sides communicating with the exterior of the enclosure, openings in the vertical beams on the inner sides communicating with the interior of the enclosure, and an exhaust fan mounted on an enclosure wall or ceiling.

15. A noise reduction enclosure as defined in claim 11, which further includes a built-in ventilation system comprising openings in each of the vertical beams adjacent the upper ends thereof communicating with the exterior of the enclosure, openings in each of the vertical beams adjacent the lower ends thereof communicating with the interior of the enclosure, and an exhaust fan mounted in the ceiling.

16. A noise reduction enclosure as defined in claim 11, wherein the walls include material passages having seal means inhibiting noise leaks.

17. A noise reduction enclosure as defined in claim 13, wherein the rubber sealing strip includes a base portion trapezoidal in cross section and an outer hollow portion for engaging the beams.

18. A noise reduction enclosure as defined in claim 14, wherein the outer openings are adjacent the upper ends of the beams and the inner openings are adjacent the lower ends of the beams.

19. A noise reduction enclosure as defined in claim 18, wherein the exhaust fan is mounted in the ceiling.

* * * * *